US006843322B2

(12) United States Patent
Burtner et al.

(10) Patent No.: US 6,843,322 B2
(45) Date of Patent: Jan. 18, 2005

(54) MONOBORE SHOE

(75) Inventors: James C. Burtner, Spring, TX (US); Alan Brent Emerson, Cypress, TX (US); Matthew J. Jabs, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 83 days.

(21) Appl. No.: 10/442,788

(22) Filed: May 21, 2003

(65) Prior Publication Data

US 2003/0221841 A1 Dec. 4, 2003

Related U.S. Application Data

(60) Provisional application No. 60/384,804, filed on May 31, 2002.

(51) Int. Cl.[7] ..... E21B 23/00

(52) U.S. Cl. ..... 166/382; 166/207; 166/208

(58) Field of Search ..... 166/382, 378, 166/77.51, 89.1, 208, 106, 207, 217

(56) References Cited

U.S. PATENT DOCUMENTS

| | | | | |
|---|---|---|---|---|
| 2,017,451 A | | 10/1935 | Wickersham | |
| 5,390,742 A | | 2/1995 | Dines et al. | |
| 5,794,702 A | * | 8/1998 | Nobileau | 166/380 |
| 5,829,524 A | | 11/1998 | Flanders et al. | |
| 6,470,966 B2 | * | 10/2002 | Cook et al. | 166/207 |
| 6,695,063 B2 | * | 2/2004 | Lauritzen et al. | 166/380 |
| 6,698,517 B2 | * | 3/2004 | Simpson et al. | 166/277 |
| 6,702,029 B2 | * | 3/2004 | Metcalfe et al. | 166/378 |
| 6,758,278 B2 | * | 7/2004 | Cook et al. | 166/380 |

FOREIGN PATENT DOCUMENTS

| | | |
|---|---|---|
| WO | WO 01/04520 A1 | 1/2001 |
| WO | WO 02/29199 A1 | 4/2002 |

* cited by examiner

*Primary Examiner*—Frank Tsay
(74) *Attorney, Agent, or Firm*—Steve Rosenblatt

(57) ABSTRACT

A method of attaching a tubular to an existing tubular in a well without reducing the inside diameter of the well is described. A shoe is attached to the lower end of the existing lowermost casing or tubular, generally prior to the casing being cemented or otherwise secured in the wellbore. The shoe has a diameter larger than the inside diameter of the casing or tubular to which it is attached. Subsequently, a liner is run in until its top end is in the enlarged diameter region of the shoe. A hanger can be optionally used. The liner is expanded into the enlarged diameter so that the net result is that the inside diameter in the wellbore is not reduced by the addition of the liner.

20 Claims, 4 Drawing Sheets

MONOBORE SHOE

PRIORITY INFORMATION

This application claims the benefit of U.S. Provisional Application No. 60/384,804 on May 31, 2002.

FIELD OF THE INVENTION

The field of this invention relates to downhole completion techniques involving insertion of liners or tubulars and tying them to existing tubulars without reduction of internal well dimension, generally using the technique of expansion.

BACKGROUND OF THE INVENTION

Frequently, during drilling beyond a cased and cemented portion of a wellbore, the fluid losses become unacceptable. This forces the drilling operation to be suspended, as the exposed zone where the fluid loss is happening is isolated. One way to do this is to lower a liner with or without a liner hanger so that there is some overlap with existing casing and expand the liner or hanger into the existing well casing. The downside of this procedure is that the well diameter is now reduced by the wall thickness of the liner, despite the expansion of the liner or its hanger.

Situations requiring liners or the like can also occur when, during drilling, a very unconsolidated formation needs to be traversed to get to the producing zone.

The present invention addresses these and other situations by allowing placement of tubulars in a wellbore to be secured to existing casing or tubulars in the wellbore, without a decrease in the inside diameter in the wellbore due to the newly added tubular. Various versions of a shoe that connects to the casing or tubular in the wellbore, allows the newly inserted tubular to be engaged, generally by expansion, in an area of increased diameter so that when fully supported in the shoe, the wall thickness of the newly added tubular is in a recess and the internal well dimension is not reduced. These and other features of the present invention will be apparent to those skilled in the art from a review of the various embodiments described below in the detailed description and from the claims presented.

SUMMARY OF THE INVENTION

A method of attaching a tubular to an existing tubular in a well without reducing the inside diameter of the well is described. A shoe is attached to the lower end of the existing lowermost casing or tubular, generally prior to the casing being cemented or otherwise secured in the wellbore. The shoe has a diameter larger than the inside diameter of the casing or tubular to which it is attached. Subsequently, a liner is run in until its top end is in the enlarged diameter region of the shoe. A hanger can be optionally used. The liner is expanded into the enlarged diameter so that the net result is that the inside diameter in the wellbore is not reduced by the addition of the liner.

DETAILED DESCRIPTION OF THE DRAWINGS

Figure 1A:
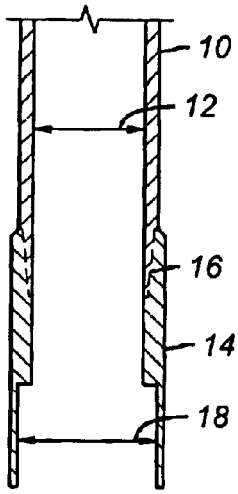
Figure 1B:
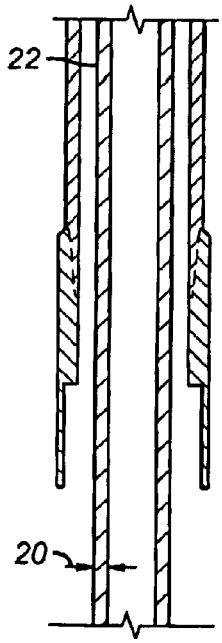
Figure 1C:
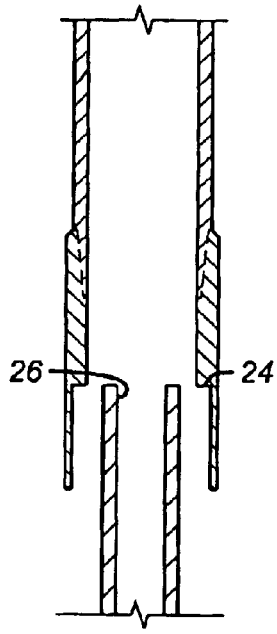
Figure 2A:
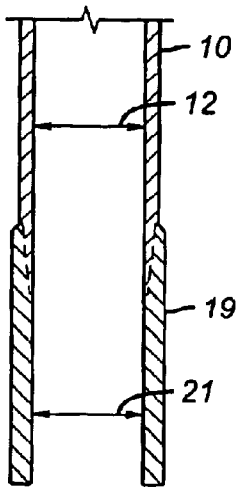
Figure 2B:
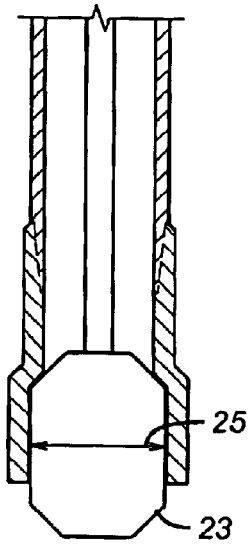
Figure 2C:
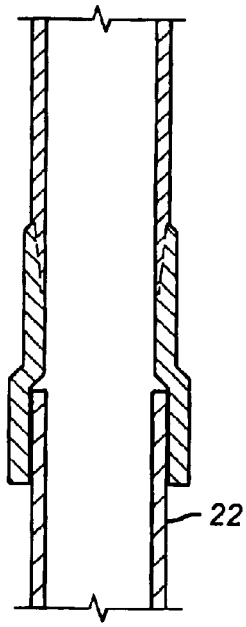
Figure 3A:
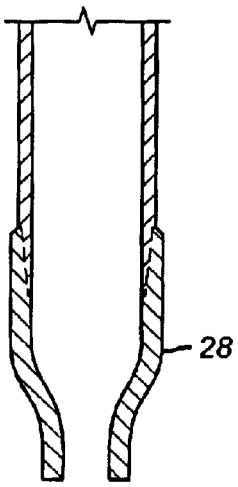
Figure 3B:
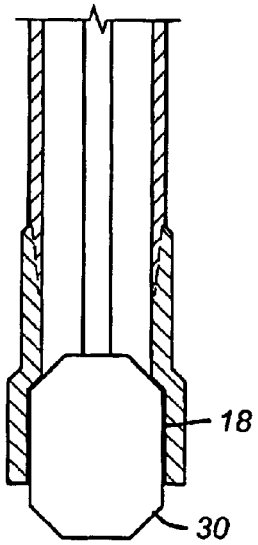
Figure 3C:
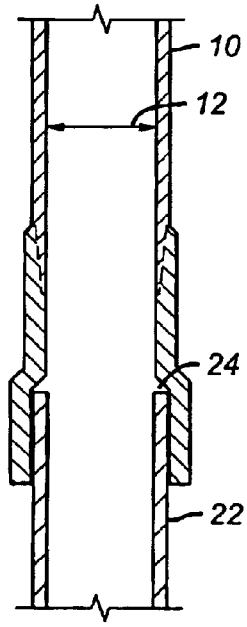
Figure 4A:
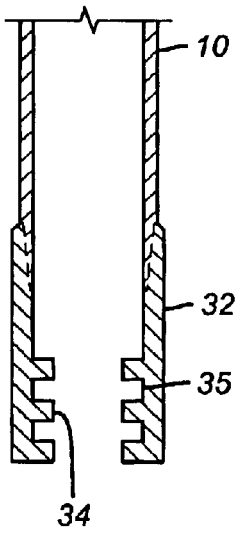
Figure 4B:
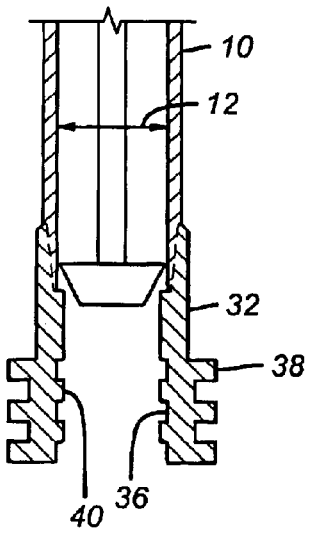
Figure 5A:
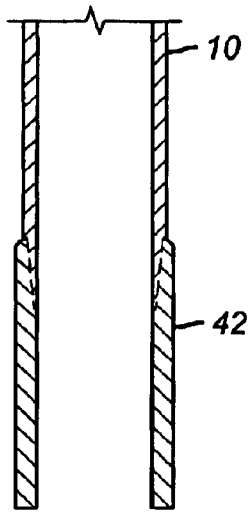
Figure 5B:
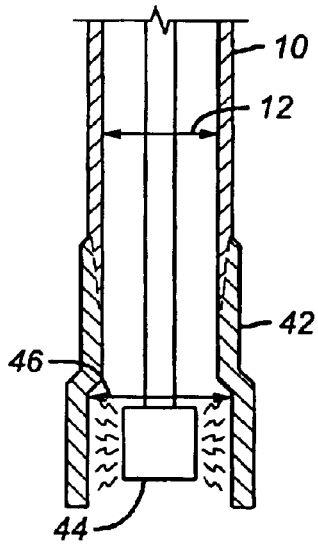
Figure 6A:
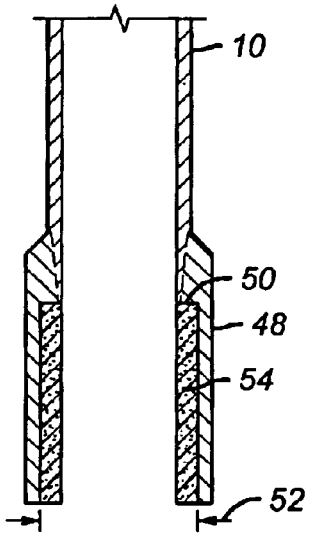
Figure 6B:
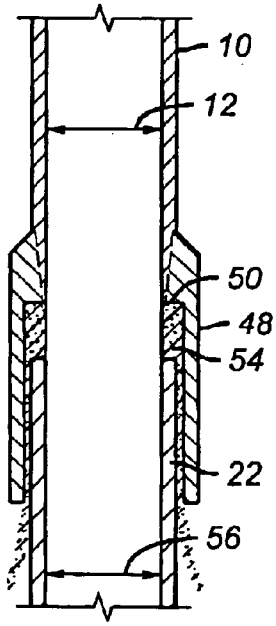
Figure 7A:
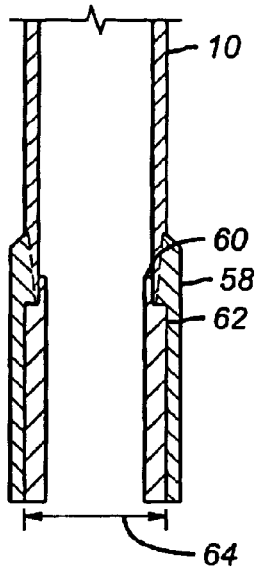
Figure 7B:
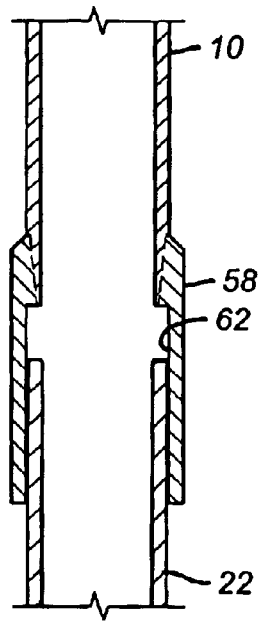

FIGS. 1*a*–1*c* the method with a shoe having an enlarged inside diameter;

FIGS. 2*a*–*c* illustrate the method with an expandable shoe;

FIGS. 3*a*–3*c* illustrate the method with a pre-crushed shoe;

FIGS. 4*a*–4*b* illustrate the method with a special profile shoe;

FIGS. 5*a*–5*b* illustrate the method with a memory metal shoe;

FIGS. 6*a*–6*b* illustrate the method with a soft material filled shoe;

FIGS. 7*a*–7*b* illustrate the method with a covered recess shoe; and

Figure 8A:
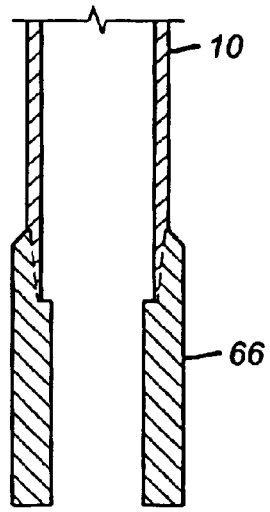
Figure 8B:
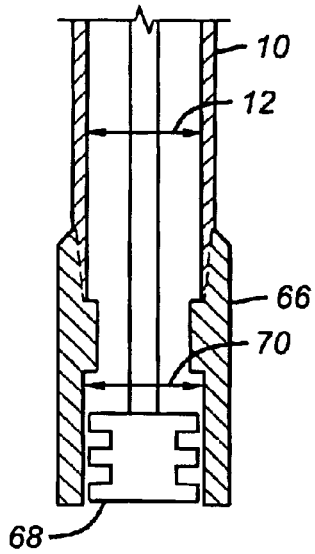

FIGS. 8*a*–8*b* illustrate the method with a machined shoe.

DETAILED DESCRIPTION OF THE PREFERRED EMBODIMENT

In this application reference to "casing" is intended to encompass all manner of tubulars found in a wellbore, whether cemented or otherwise secured. In FIG. 1*a* the casing 10 has an inside diameter 12. A shoe 14 is attached at lower end 16. Shoe 14 has a diameter 18 that is larger than inside diameter 12. Preferably, the wall thickness 20 of a tubular 22 will, when expanded against diameter 18 will not create an internal dimension below shoe 14 that is smaller than diameter 12. The recess in shoe 14 defined by diameter 18 being larger than diameter 12 allows accommodation of the wall thickness 20 of the tubular 22, after expansion into contact with shoe 14 to avoid well constriction. It should be noted that the casing 10 has most likely been previously cemented or otherwise fixated limiting its ability to further expand appreciably without application of excessive amounts of force. The shoe 14 is not limited in the same manner as the casing and can expand with the tubular 22. The casing 10 may itself be fixated by expansion along with shoe 14. Subsequently, the tubular 22 is delivered on a running string in combination with a known swage and expansion into diameter 18 takes place until the tubular 22 is secured. At that time the swage is removed with the running string (not shown) in a known manner. In essence, shoulder 24 is deep enough to accept the wall thickness 20 with no part of it, after fixation extending beyond so as to reduce the diameter 12 of casing 10. FIGS 1*a*–1*c* show schematically the insertion of the casing 10 with the shoe 14. Subsequently, the tubular 22 is lowered into position. It may optionally have known seals and/or a liner hanger (not shown) attached near upper end 26. FIG. 1*c* shows the tubular 22 in position and ready for attachment to shoe 14, preferably by a known expansion technique.

FIGS. 2*a*–2*c* show a shoe 19 on casing 10 where the internal diameter 21 of shoe 19 is nearly the same as the diameter 12. A known expansion device 23 can create a diameter 25 larger than diameter 21. Thereafter, the tubular 22 can be expanded or otherwise attached to diameter 25. The tubular 22 can also be delivered prior to expansion of diameter 21 so that the shoe 19 and the tubular 22 are both expanded together in a single step, as opposed to the two steps required in the illustrations of FIGS. 2*a*–2*c*.

FIGS. 3*a*–3*c* illustrate a crushed shoe 28 that has a reduced end diameter to facilitate running in the casing 10. Once the casing 10 is in position, an expansion tool 30 reforms the shoe 28 so that it has the enlarged diameter 18. Thereafter, the tubular 22 can be expanded into recess 24 without intruding into the diameter 12 of the casing 10. Again, seals and/or hangers can be used on tubular 22 and expanded or otherwise set into enlarged diameter 18.

FIGS. 4*a*–4*b* show a shoe 32 with a series of projections 34 and alternating valleys 35. This can be a thread pattern or some other kind of pattern or a random distribution of peaks and valleys. FIG. 4*b* shows that after expansion with a known tool 30, the peaks 34 become valleys 36 on the inside while on the outside what have previously been a valley 35 become external peaks 38. The external peaks 38 help to fixate the shoe 32 in the wellbore. The diameter defined by internal peaks 40, is preferably more than diameter 12. The tubular 22 could be subsequently introduced and expanded against peaks 40 for gripping contact. The tubular 22 could also be expanded at the same time as the shoe 32 is initially expanded for a single trip operation.

FIGS. 5*a*–5*b* illustrate a shoe 42 made from a well-known memory material. A memory material responds to electrical, acoustical or thermal inputs from a tool 44 to change shape to create the enlarged diameter zone 46. Thereafter, the tubular 22 can be expanded into zone 46 to secure it without reducing the diameter 12 above. As with the other embodiments previously described, seals and/or a hanger can be used in conjunction with an expansion technique with a swage or some other method of mechanical fixation can be used if the end result is that the diameter 12 is at least as large as the internal diameter of the tubular 22 after it becomes supported. The shape change and the fixation of tubular 22 can also occur in a single trip.

FIGS. 6*a*–6*b* illustrate a shoe 48 with a recess 50 so that it has a larger diameter 52 than diameter 12. The recess 50 is initially filled with a soft material 54 that is compatible with well pressures, temperatures and fluids. It could be aluminum, lead, a composite, foam, plastic or any other material that will be easily displaced during drilling, expansion or fixation of the tubular 22. The material 54 protects the large diameter 52 until the tubular 22 is in position and is expanded, as shown in FIG. 6*b*. Some or all of the material 54 may be displaced during the expansion or fixation. In the end, the inside diameter 56 is close to or greater than diameter 12.

FIGS. 7*a*–7*b* illustrate a shoe 58 with a sleeve 60 in a recess 62. After the shoe 58 is properly positioned downhole the sleeve 60 can be removed by a variety of techniques. It can be physically displaced, chemically dissolved or attacked, thermally attacked or any other technique that will get it out of the way to expose the larger diameter 64 that is defined by recess 62. The tubular 22 can be fixed such as by expansion, in larger diameter 64 with the result as described before that there is little if any reduction in the internal diameter 12 going further downhole. The tubular 22 can remove the sleeve 60 as it is lowered into position.

Finally FIGS. 8*a*–8*b* show a shoe 66 that is attached to the casing 10 and machined or otherwise has its internal dimension increased after it is positioned in the wellbore. For example a mill or reaming tool 68 can be used to create a larger diameter 70 than diameter 12.

Those skilled in the art will appreciate that the various illustrated embodiments of the method of the present invention allow the attachment of a tubular to casing where after the conclusion of the attachment, the diameter of the tubular is close to the internal diameter of the casing above and even greater. Contrasted to prior techniques that overlapped the tubular with the casing and resulted in a decrease in internal diameter in the order of the thickness of the wall of the tubular, the present invention gives a simple way to overcome this problem and allow for minimal or no reduction in internal diameter and even an increase in the internal diameter. Currently the technique in FIGS. 1–1*c* is preferred.

The foregoing disclosure and description of the invention are illustrative and explanatory thereof, and various changes in the size, shape and materials, as well as in the details of the illustrated construction, may be made without departing from the spirit of the invention.

We claim:

1. A well completion method, comprising:

running in casing having a first inside diameter;

providing a shoe adjacent the lower end of said casing;

running a tubular string through said casing until the upper end of the tubular string is adjacent said shoe;

expanding at least a portion of said tubular string into supporting engagement with said shoe so that a second inside diameter of said tubular string, after expansion, in said shoe is at least as large as said first inside diameter of said casing.

2. The method of claim 1, comprising:

providing an initial third inside diameter in said shoe that is smaller than said first diameter in said casing.

3. The method of claim 1, comprising:

providing an initial third inside diameter in said shoe that is larger than said first diameter in said casing.

4. The method of claim 1, comprising:

providing an initial third inside diameter in said shoe that is substantially the same as said first diameter in said casing.

5. The method of claim 4, comprising:

expanding said tubular sting and said shoe in a single trip into the wellbore.

6. The method of claim 1, comprising:

providing an initial third inside diameter in said shoe that is altered downhole.

7. The method of claim 6, comprising:

increasing said third diameter by swaging said shoe.

8. The method of claim 6, comprising:

increasing said third diameter by swaging said tubing string into said shoe.

9. The method of claim 6, comprising:

increasing said third diameter by removing portions of said shoe.

10. The method of claim 8, comprising:

using a mill or drill bit to remove portions of said shoe downhole.

11. The method of claim 6, comprising:

providing a sleeve in said shoe;

removing the sleeve downhole.

12. The method of claim 11, comprising:

making the sleeve of a soft material;

displacing said sleeve with expansion of the tubular string in said shoe.

13. The method of claim 11, comprising:

mechanically removing said sleeve from said shoe.

14. The method of claim 11, comprising:

chemically removing said sleeve from said shoe.

15. The method of claim 9, comprising:

removing said sleeve by thermal exposure to fluids downhole.

16. The method of claim 6, comprising:

making said shoe from a shape memory material;

providing the input to said shoe to increase said third inside diameter.

17. The method of claim 1, comprising:

providing an internal surface within said shoe comprising a plurality of projections and depressions;

expanding the tubular string into said internal surface.

18. The method of claim 17, comprising:

creating a plurality of projections and depressions on an outer surface of said shoe by virtue of said expansion of said tubular string into said internal surface.

19. The method of claim 1, comprising:

using at least one seal between said tubular string and said shoe.

20. The method of claim 1, comprising:

using a hanger between said tubular string and said shoe.

* * * * *